United States Patent [19]

Sato

[11] Patent Number: 5,055,063

[45] Date of Patent: Oct. 8, 1991

[54] MULTICONDUCTOR CABLE CONNECTOR AND METHOD OF LOADING SAME

[75] Inventor: Kensaku Sato, Tokyo, Japan

[73] Assignee: Hirose Electric Co., Ltd., Tokyo, Japan

[21] Appl. No.: 610,980

[22] Filed: Nov. 9, 1990

[30] Foreign Application Priority Data

Nov. 17, 1989 [JP] Japan ..... 1-297714

[51] Int. Cl.[5] ..... H01R 4/24

[52] U.S. Cl. ..... 439/395; 439/607

[58] Field of Search ..... 439/389–425, 439/607–610

[56] References Cited

U.S. PATENT DOCUMENTS 4,648,679 3/1987 Pelczarski ..... 339/99

4,790,775 12/1988 David ..... 439/579

*Primary Examiner*—Joseph H. McGlynn

*Attorney, Agent, or Firm*—Kanesaka & Takeuchi

[57] ABSTRACT

An electrical connector for a multiconductor cable, which includes a shielding case (3) including a contact retention portion (6) with a jig inlet (10) extending forwardly from a rear edge of a top face thereof, a shield wires crimping portion (7) with crimping tabs (12) for crimping shield wires of the multiconductor cable, and an outer sheath crimping portion (8) with crimping tabs (13) for crimping an outer sheath of the multiconductor cable; an insulator body (4) provided with the contact retention portion; and at least one signal line contact (5) having a contact body and an insulated conductor insulation displacing portion (15) with at least one insulation displacing contact (17) to which an insulated conductor of the multiconductor cable is connected by insulation displacement and supported by the insulation body such that the insulated conductor insulation displacing portion is positioned in the jig inlet.

2 Claims, 4 Drawing Sheets

MULTICONDUCTOR CABLE CONNECTOR AND METHOD OF LOADING SAME

BACKGROUND OF THE INVENTION

1. Field of the Invention

The present invention relates to electrical connectors for shielded multiconductor cables of electronic equipment in automobiles, for example, and methods of loading such a multiconductor cable on the electrical connector.

2. Description of the Prior Art

FIG. 8 shows a conventional shielded cable connector which is connected by stripping a length of outer sheath g from a multiconductor cable a, separating shield wires b from an insulated conductor c, bundling and connecting the shield wires b to the contact terminal e of a connector body d while connecting the insulated conductor c to the contact terminal f by insulation displacing technique, for example.

However, in the above connector, it has been necessary to connect separately the shield wires b and the insulated conductor c to the contact terminal e and the contact terminal f, respectively. Since multiconductor cables have a number of insulated conductors c, it has been very difficult to streamline and automate the connection operation. In addition, the shield wires were removed adjacent the connector body d, the insulated conductors c have had no shielding protection in the area.

SUMMARY OF THE INVENTION

Accordingly, it is an object of the invention to provide a multiconductor cable connector which has an excellent shielding effect and permits simultaneous connection by insulation displacement of the insulated conductors and by crimping of the shield wires and outer sheath, thereby making possible continuous and automatic connection of a great number of insulated conductors to the electrical connector.

It is another object of the invention to provide a method of loading a multiconductor cable on such an electrical connector as described above.

According to one aspect of the invention, there is provided an electrical connector for a multiconductor cable, which includes a shielding case including a contact retention portion with a jig inlet extending forwardly from a rear edge of a top face thereof, a shield wires crimping portion with crimping tabs for crimping shield wires of the multiconductor cable, and an outer sheath crimping portion with crimping tabs for crimping an outer sheath of the multiconductor cable; an insulator body provided within the contact retention portion; and at least one signal line contact having a contact body and an insulated conductor insulation displacing portion with at least one insulation displacing contact to which an insulated conductor of the multiconductor cable is connected by insulation displacement and supported by the insulation body such that the insulated conductor insulation displacing portion is positioned in the jig inlet.

According to another aspect of the invention there is provided a method of loading a multiconductor cable on the electrical connector of claim 1, which includes the steps of placing a prepared end portion of the multiconductor cable on the shielding case such that the insulated conductor, shield wires, and outer sheath are placed on the insulation displacing contact, and the crimping tabs, respectively; and pressing the insulated conductor onto the insulation displacing contact by means of an insulation displacing jig and the crimping tabs onto the shield wires and outer sheath, respectively, by means of crimping jigs for effecting connection.

With the electrical connector according to the invention, since the stripped end portion of a multiconductor cable is simply placed on the contact terminal such that the insulated conductors, shield wires, and outer sheath are placed on the insulation displacing contact and the crimping tabs, respectively, which are then pressed for effecting connection by means of insulation displacing and crimping jigs, automatic simultaneous connection of a great number of insulated conductors is possible.

The above and other objects, features, and advantages of the invention will be more apparent from the following description when taken in conjunction with the accompanying drawings.

DESCRIPTION OF THE PREFERRED EMBODIMENT

Figure 1:
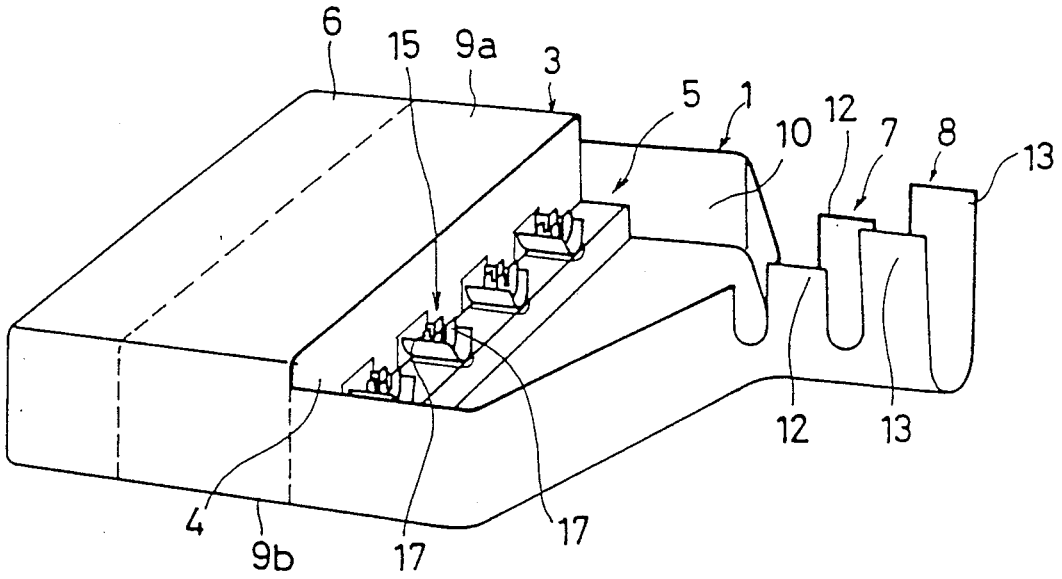
FIG. 1 is a perspective view of an electrical contact terminal according to an embodiment of the invention.
Figure 2:
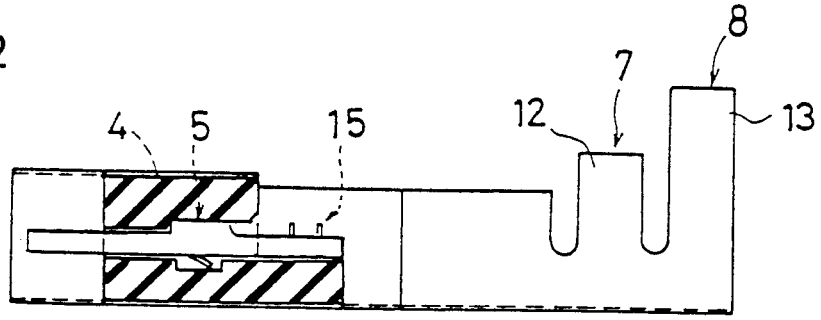
FIG. 2 is a longitudinal section thereof.
Figure 3:
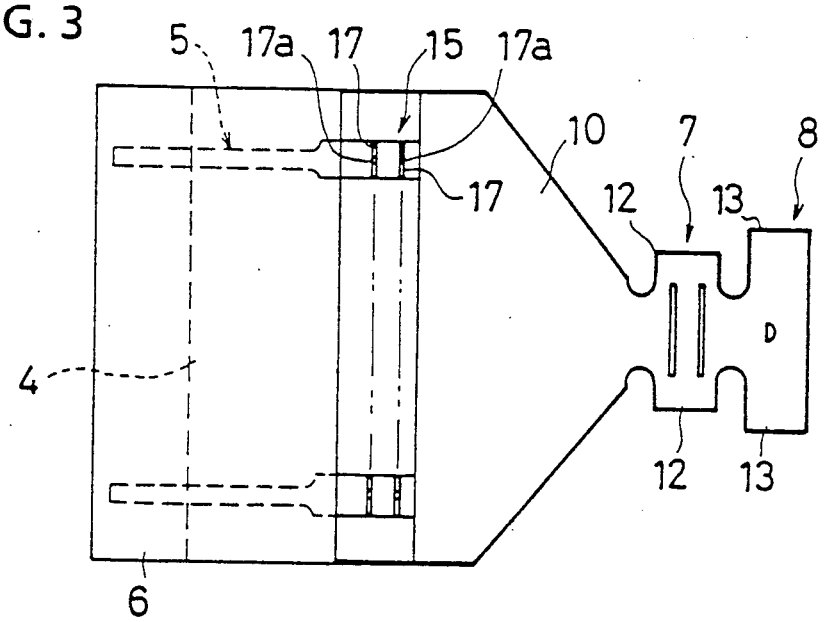
FIG. 3 is a top plan view thereof.
Figure 4:
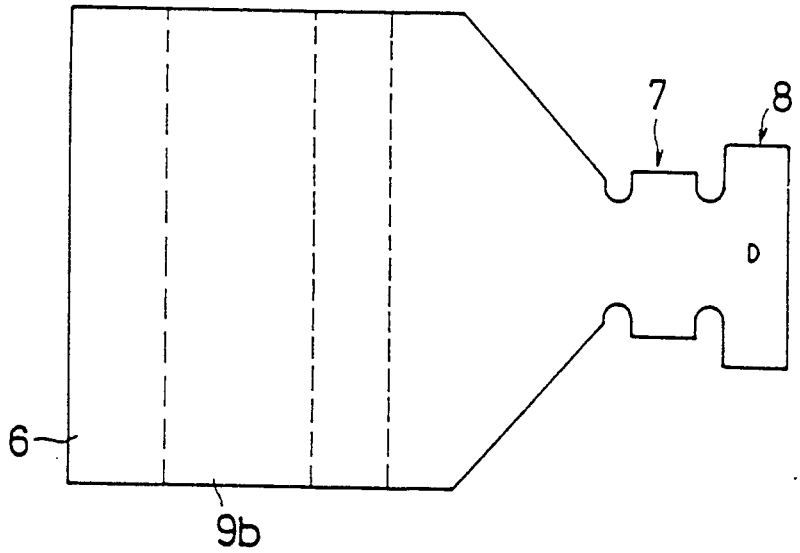
FIG. 4 is a bottom plan view thereof.

FIGS. 1–4 show a multiconductor cable connector according to an embodiment of the invention. The connector includes an electrical contact terminal 1 within a housing (not shown). The contact terminal 1 includes a shielding case 3, an insulation body 4, and four insulated conductor contacts 5 in this embodiment. The shielding case 3 is divided into three portions; a contact retention portion 6 with a rectangular cross-section, a shield wires (outer conductor) crimping portion 7, and an outer sheath retention portion 8. An opening 10 extends rearwardly from the rear edge of a top face 9*a* and serves as a jig inlet. The shield wires crimping portion 7 has a pair of U-shaped crimping tabs 12, while the outer sheath retention portion 8 has a pair of U-shaped crimping tabs 13 which are larger than the crimping tabs 12.

Figure 5:
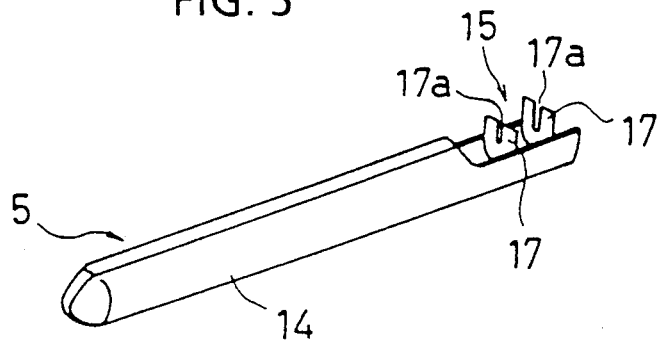
FIG. 5 is a perspective view of a insulated conductor contact according to an embodiment of the invention.

As FIG. 5 shows, the insulated conductor contact 5 has a contact body 14 and an insulated conductor insulation displacing portion 15. The contact body 14 is shaped in the form of a pin, while the insulated conductor insulation displacing portion 15 has a pair of insulation displacing contacts 17 with a slit 17*a* extending downwardly from the top edge thereof. The insulator crimping portion 16 also has a pair of U-shaped crimping tabs 18. The insulated conductor contacts 5 are supported within the contact retention portion 6 via the insulation body 4 to make an electrical contact terminal 1 such that the insulation displacing portions 15 of the insulated conductor contacts 5 are positioned in the jig inlet 10 of the contact retention portion 6.

Figure 6A:
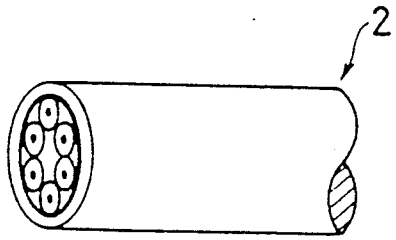
FIGS. 6(*a*), (*b*), and (*c*) illustrate how to prepare an end portion of a multiconductor cable.
Figure 6B:
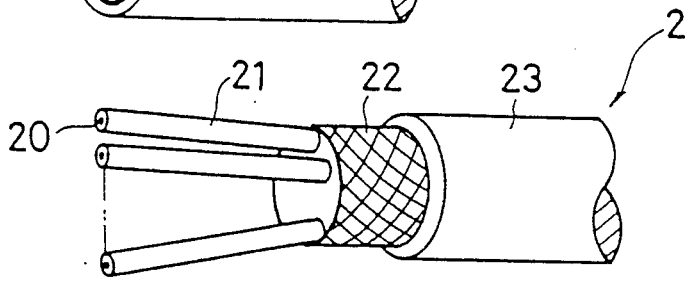
Figure 6C:
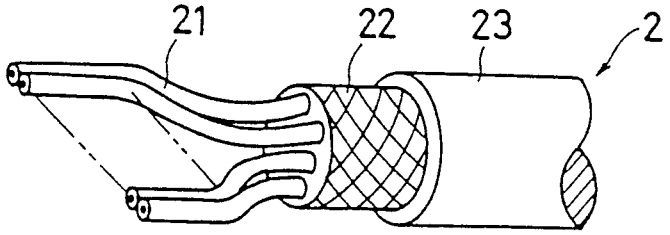

In order to connect a multiconductor cable 2 to the electrical contact terminal 1, first of all, as FIGS. 6(*a*) and (*b*) show, a length of outer sheath 23 is removed from the multiconductor cable 2 to expose the insulated conductors (central conductors) 20 with the intermediate insulator 21 and the shield wires (outer conductor) 22. Then, as FIG. 6(*c*) shows, the insulated conductors 20 are arranged in a row by heat welding or taping. The prepared shielded cable 2 is then placed on the electrical contact terminal 1 so that the insulated conductors 20, the shield wires 22, and the outer sheath 23 are placed on the insulation displacing contacts 17 and the crimping tabs 12 and 13, respectively.

Figure 7:
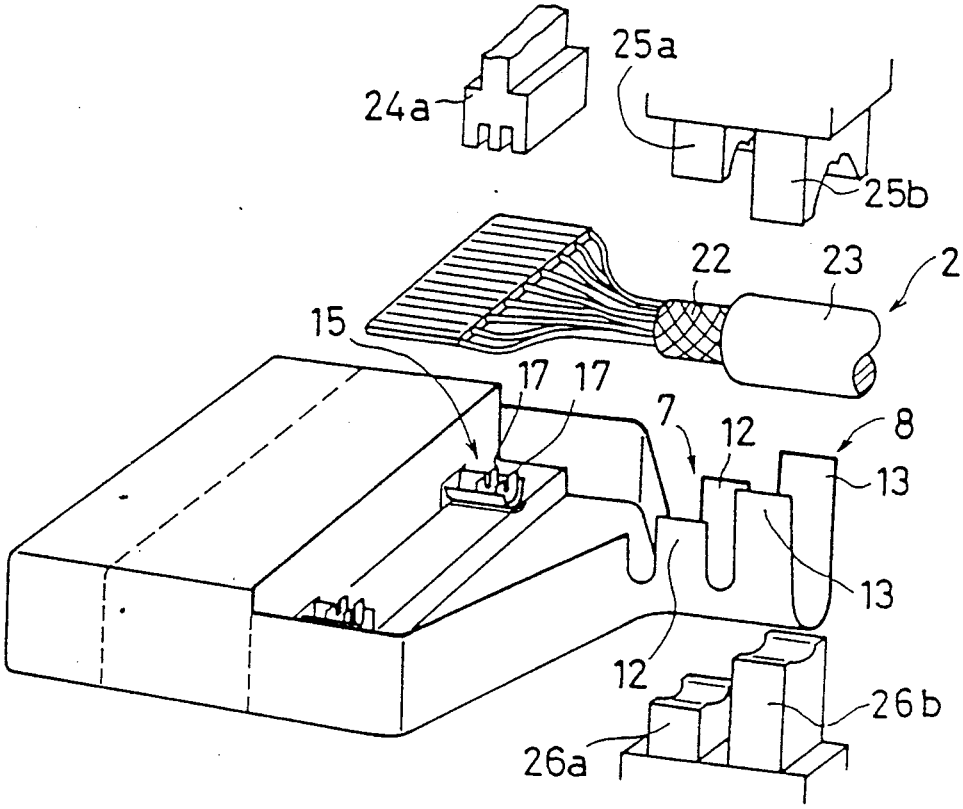
FIG. 7 illustrates how to connect by insulation displacement the insulated conductors of a multiconductor cable to the electrical contact terminals.
Figure 8:
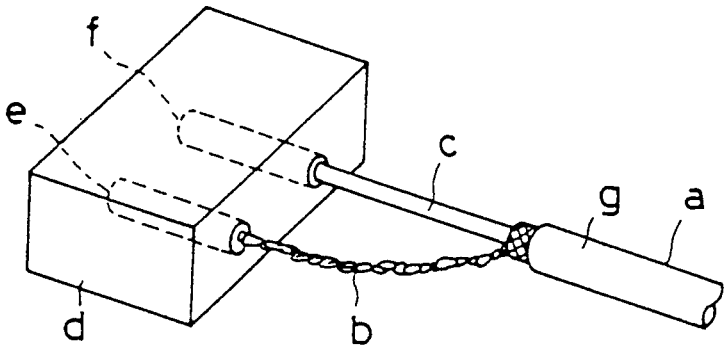
FIG. 8 PRIOR ART
FIG. 8 is a perspective view of a conventional electrical connector.

As FIG. 7 shows, the insulated conductors 20 are connected to the insulation displacing contact 17 by means of the anvils 24*a* while the crimping tabs 12 and 13 are crimped to the shield wires 22 and the outer sheath 23, respectively, by means of anvils 26*a* and 26*b* and crimpers 25*a* and 25*b*.

More specifically, the anvil 24*a* is inserted through the jig inlet 10 to press the insulated conductors 20 onto the insulation displacing contacts 17 for effecting connection while the anvils 26*a* and 26*b* and the crimpers 25*a* and 25*b* are operated to press the crimping tabs 12 and 13 onto the shield wires 22 and the outer sheath 23, respectively, for connecting the multiconductor cable 2 to the electrical contact terminal 1. The contact terminal 1 is then provided with an insulation cover (not shown) to make a finished connector.

Alternatively, the insulated conductors of a multiconductor cable, which are arranged in a row and pressed all at once for effecting connection in the above embodiment, may be pressed one at a time for effecting connection by insulation displacement.

As has been described above, with the electrical contact terminal according to the invention, it is easy to connect a multiconductor cable to the electrical connector by simply placing the multiconductor cable on the contact terminal so that the insulated conductors, shield wires, and outer sheath are placed on the insulation displacing contacts and the crimping tabs, respectively, and pressing the insulated conductors onto the insulation displacing contacts in the jig inlet by means of the insulation displacing anvil and the crimping tabs by means of anvils and crimpers. This makes possible continuous and automatic connection of a large number of insulated conductors of a multiconductor cable, and thus considerable reduction in the manufacturing costs. In addition, the insulated conductors and the insulated conductor contacts are covered by the shielding case, providing an enhanced shielding effect.

I claim:

1. An electrical connector for a multiconductor cable, comprising:

a shielding case including a contact retention portion with a jig inlet extending rearwardly from a rear edge of a top face thereof, a shield wires crimping portion with a pair of U-shaped crimping tabs for crimping shield wires of said multiconductor cable, and an outer sheath crimping portion with a pair of U-shaped crimping tabs for crimping an outer sheath of said multiconductor cable;

an insulator body provided within said contact retention portion; and at least one signal line contact having a contact body and an insulated conductor insulation displacing portion with at least one insulation displacing contact to which an insulated conductor of said multiconductor cable is connected by insulation displacement and supported by said insulation body such that said insulated conductor insulation displacing portion is positioned in said jig inlet.

2. A method of loading a shielded multiconductor cable on said electrical connector of claim 1, which comprises the steps of:

placing a prepared end portion of said multiconductor cable on said shielding case such that said insulated conductor, shield wires, and outer sheath are placed on said insulation displacing contact and said crimping tabs, respectively; and pressing said insulated conductor onto said insulation displacing contact by means of an insulation displacing jig and said crimping tabs onto said shield wires and outer sheath, respectively, by means of crimping jigs for effecting connection.

* * * * *